US009167858B2

(12) United States Patent
Lane

(10) Patent No.: US 9,167,858 B2
(45) Date of Patent: Oct. 27, 2015

(54) HAIR ADDITION

(75) Inventor: Teresa Lane, Hallendale Beach, FL (US)

(73) Assignee: Celebrity Signatures International, Inc., Kansas City, MO (US)

( * ) Notice: Subject to any disclaimer, the term of this patent is extended or adjusted under 35 U.S.C. 154(b) by 791 days.

(21) Appl. No.: 12/834,525

(22) Filed: Jul. 12, 2010

(65) Prior Publication Data

US 2011/0005544 A1 Jan. 13, 2011

Related U.S. Application Data

(60) Provisional application No. 61/224,734, filed on Jul. 10, 2009.

(51) Int. Cl.
*A41G 3/00* (2006.01)
*A41G 5/00* (2006.01)

(52) U.S. Cl.
CPC ..... *A41G 5/0073* (2013.01); *A41G 5/006* (2013.01); *A41G 5/004* (2013.01); *A41G 5/0053* (2013.01)

(58) Field of Classification Search
CPC ..... A41G 5/004; A41G 5/002; A41G 5/006; A41G 5/0073; A41G 5/00
USPC ..... 132/53–56, 201
See application file for complete search history.

(56) References Cited

U.S. PATENT DOCUMENTS

| | | | |
|---|---|---|---|
| 125,382 | A | 4/1872 | Gutter |
| 541,125 | A | 6/1895 | Simonson |
| 1,424,845 | A | 8/1922 | Nolan |
| 1,519,107 | A | 12/1924 | Breslauer |
| 1,549,334 | A | 1/1925 | Ruffio |
| 1,540,102 | A | 4/1925 | Cohen |
| 1,665,380 | A | 4/1925 | Ruffio |
| 1,638,016 | A | 2/1927 | Oppenheim |
| 1,780,766 | A | 12/1929 | Oppenheim |
| 1,775,209 | A | 9/1930 | Oppenheim |
| 2,651,310 | A | 9/1952 | Selson |

(Continued)

FOREIGN PATENT DOCUMENTS

| | | |
|---|---|---|
| JP | 50-000960 | 1/1975 |
| JP | 03060852 | 6/1999 |

OTHER PUBLICATIONS

International Search Report of related PCT application No. PCT/US2010/041715, issued Jan. 13, 2011, 3 pages.

(Continued)

*Primary Examiner* — Robyn Doan
(74) *Attorney, Agent, or Firm* — Lathrop & Gage LLP

(57) ABSTRACT

Hair additions and their methods of construction are set forth. A hair addition according to one embodiment includes a plurality of hair strands having upper and lower ends, at least two threads coupling the upper ends together, and two layers of polyurethane sandwiching the hair strand upper ends and the at least two threads. The two layers of polyurethane form a strip, and at least one clip is coupled to the strip. It may be desirable for a diameter of the strip to be no more than 25%-50% greater than a diameter of the hair strands. A method of formation includes: aligning a plurality of hair strands; coupling an end of the hair strands together using thread; sandwiching the coupled end of hair strands and the thread between two layers of polyurethane; curing the two layers of polyurethane; and coupling at least one clip to the cured polyurethane.

18 Claims, 5 Drawing Sheets

(56) References Cited

U.S. PATENT DOCUMENTS

| | | | | | |
|---|---|---|---|---|---|
| 2,620,809 | A | * | 12/1952 | Rosen | 132/53 |
| 3,280,826 | A | | 10/1966 | Jenkins | |
| 3,434,481 | A | | 3/1969 | Mazzocco | |
| 3,485,249 | A | | 12/1969 | Mast | |
| 3,520,310 | A | | 7/1970 | Witmondt | |
| 3,561,457 | A | | 2/1971 | Duesel | |
| 3,910,291 | A | | 10/1975 | Kim | |
| 4,600,029 | A | | 7/1986 | Ueberschaar | |
| 5,551,452 | A | | 9/1996 | Barlow | |
| 5,806,535 | A | | 9/1998 | Becker | |
| 5,873,373 | A | | 2/1999 | Narvick | |
| 5,937,867 | A | | 8/1999 | Williams | |
| 5,979,462 | A | | 11/1999 | Jones | |
| 6,016,814 | A | | 1/2000 | Elliott | |
| 6,019,107 | A | | 2/2000 | Overmyer et al. | |
| 6,035,861 | A | | 3/2000 | Copello | |
| 6,105,584 | A | | 8/2000 | Williams | |
| 6,135,125 | A | | 10/2000 | Sartena | |
| 6,257,250 | B1 | | 7/2001 | Sartena | |
| 6,513,535 | B1 | | 2/2003 | Lane | |
| 6,629,536 | B1 | | 10/2003 | Lane | |
| 6,766,805 | B1 | | 7/2004 | Cupp | |
| 6,830,054 | B1 | | 12/2004 | Ross-Kuehn | |
| 2001/0037813 | A1 | * | 11/2001 | Ra | 132/53 |
| 2004/0237987 | A1 | | 12/2004 | Gold | |
| 2005/0115581 | A1 | * | 6/2005 | Choi | 132/53 |
| 2005/0194015 | A1 | * | 9/2005 | Watts | 132/53 |
| 2005/0252518 | A1 | | 11/2005 | Salinas | |
| 2007/0006890 | A1 | | 1/2007 | Sthair | |
| 2007/0119469 | A1 | * | 5/2007 | Cho et al. | 132/53 |
| 2007/0157941 | A1 | * | 7/2007 | Awad et al. | 132/53 |

OTHER PUBLICATIONS

International Search Report and Written Opinion of related PCT application No. PCT/US2010/041715, issued Feb. 21, 2011, 8 pages.
AU Patent Application 2010271191 Patent Examination Report dated Apr. 2, 2015, 3 pages.

* cited by examiner

HAIR ADDITION

RELATED APPLICATIONS

This application claims priority to U.S. Provisional Patent Application Ser. No. 61/224,734, filed Jul. 10, 2009, the disclosure of which is incorporated herein by reference.

BACKGROUND

The disclosed subject matter is directed to hair additions, which are devices having real or synthetic hair that are worn on a user's head to complement, accent, or otherwise alter the appearance of the user's hair.

Prior art hair additions are generally constructed in ways that result in relatively thick products that do not lay very flat against the wearer's own hair or easily blend in with the user's own hair. For example, hair tufts are attached to an elastic woven fabric member or band in U.S. Pat. Nos. 6,830,054 and 1,665,380; hair tufts are attached to mesh or net material in U.S. Pat. Nos. 6,016,814, 3,520,310, and 1,549,334; and hair is coupled to a spring covered in cloth or webbing in U.S. Pat. No. 541,125.

SUMMARY

In one embodiment, a hair addition includes a plurality of hair strands having upper and lower ends, at least two threads coupling the hair strand upper ends together, and two layers of polyurethane sandwiching the hair strand upper ends and the at least two threads. The two layers of polyurethane form a strip, and at least one clip is coupled to the strip.

In another embodiment, a hair addition is formed by the process of aligning a plurality of hair strands, coupling an end of the hair strands together using at least one thread, sandwiching the coupled end of hair strands and the at least one thread between two layers of polyurethane, curing the two layers of polyurethane, and coupling at least one clip to the cured layers of polyurethane.

In still another embodiment, a method of forming a hair addition, includes the steps of aligning a plurality of hair strands, coupling an end of the hair strands together using at least one thread, sandwiching the coupled end of hair strands and the at least one thread between two layers of polyurethane, curing the two layers of polyurethane, and coupling at least one clip to the cured layers of polyurethane.

DETAILED DESCRIPTION

Figure 1:
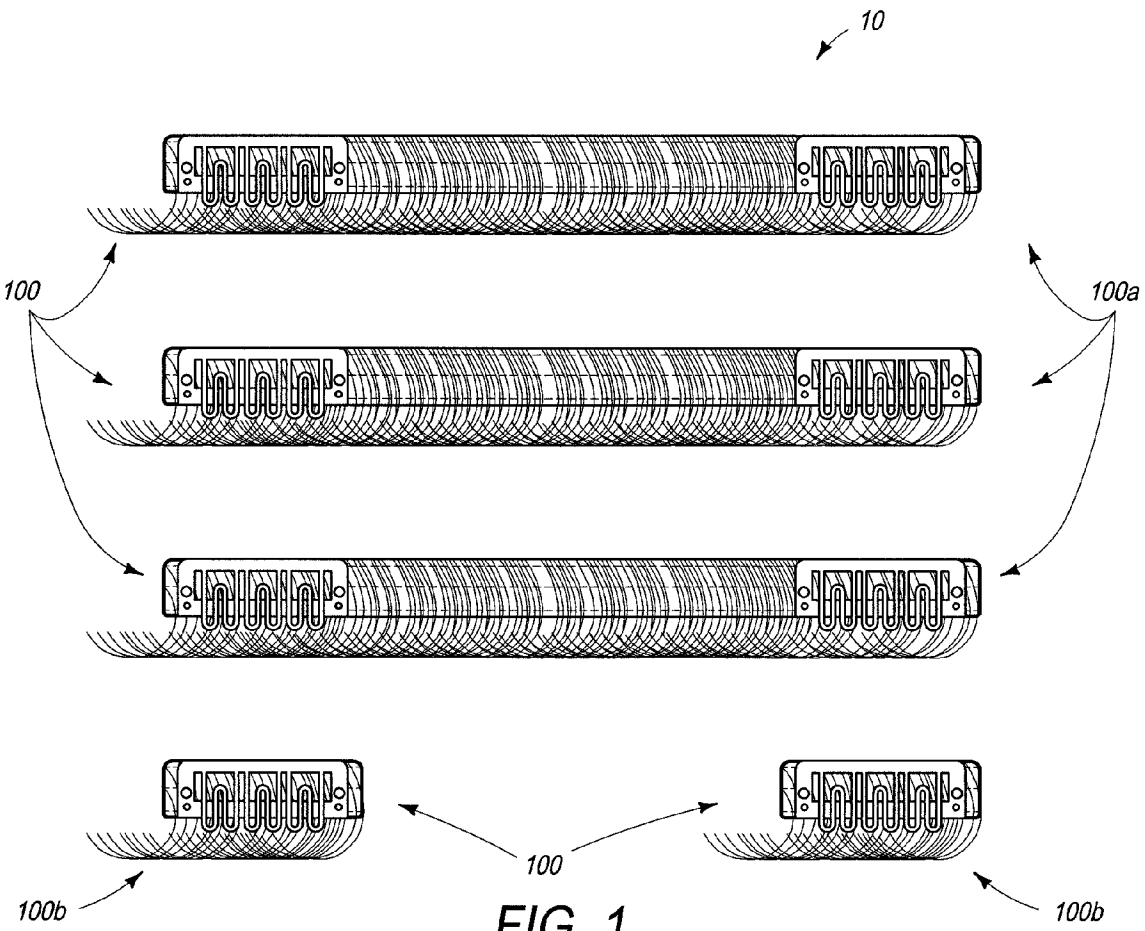
FIG. 1 shows a set, according to an embodiment set forth herein, of five hair additions.

FIG. 1 shows a set 10, according to one embodiment, of five hair additions 100 to be worn on a user's head. Two embodiments 100*a*, 100*b* of the hair additions 100 are present in the set 10.

Figure 2:
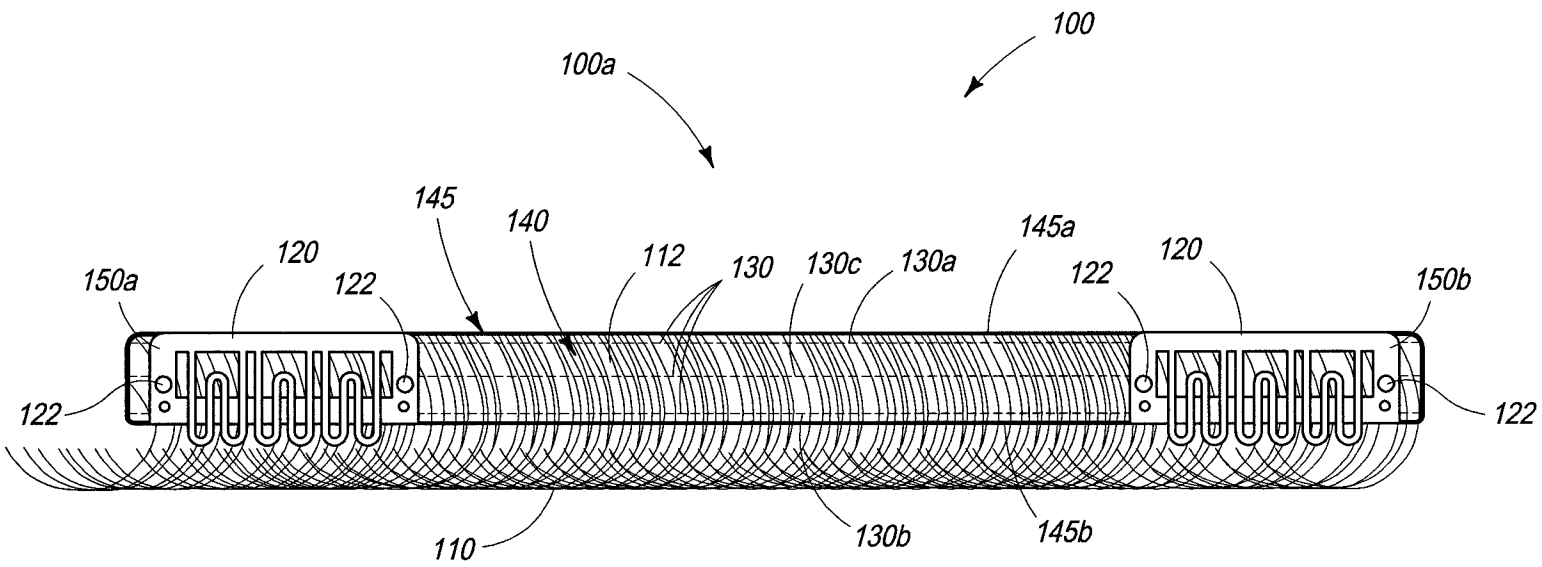
FIG. 2 shows a hair addition according to an embodiment.

Turning to FIG. 2, which specifically shows embodiment 100*a*, each hair addition 100 has hair strands 110, at least one clip 120, at least one thread 130, and adhesive 140. The embodiment 100*a* has opposed ends 150*a*, 150*b* and a length of approximately four inches between the ends 150*a*, 150*b*. Further, it includes two clips 120, one at each end 150*a*, 150*b*. Three threads 130 extend across the hair strands 110 between the ends 150*a*, 150*b* to couple ends 112 of the respective hair strands 110 to one another, and the adhesive 140 is configured such that it sandwiches the ends 112 of the hair strands 110 and the threads 130 to couple the ends 112 to one another and prevent individual hair strands 110 from falling out.

The adhesive 140 forms a strip 145 between the ends 150*a*, 150*b* and may define the ends 150*a*, 150*b*. One of the threads 130 (labeled 130*a*) is adjacent an upper end 145*a* of the strip 145, one of the threads 130 (labeled 130*b*) is adjacent a lower end 145*b* of the strip 145, and one of the threads 130 (labeled 130*c*) extends between the upper and lower ends 145*a*, 145*b*. While the upper and lower ends 145*a*, 145*b* are represented to be linear in FIG. 2, it should be appreciated that, in practice, the upper and lower ends 145*a*, 145*b* may be jagged or otherwise nonlinear. In addition, though the threads 130 are shown to be parallel to one another, they may, in practice, be skewed and even nonlinear. While various adhesives may be appropriate, it is currently preferred to use polyurethane as the adhesive 140.

Once the adhesive 140 is cured to form the strip 145, the clips 120 may be coupled to the strip 145 in various ways. In one embodiment, one stitch (not shown) passes through one hole 122 in the clip 120 to fasten one end of the clip 120 to the strip 145, and another stitch (not shown) passes through another hole 122 in the clip 120 to fasten the other end of the clip 120 to the strip 145. Adhesive may be used to couple a central area of each clip 120 to the strip 145. To ensure that each clip 120 remains concealed during use, it may be beneficial for each clip 120 to be inset from the ends 150*a*, 150*b*, and for each clip 120 to not extend to the upper end 145*a* of the strip 145.

Figure 3A:
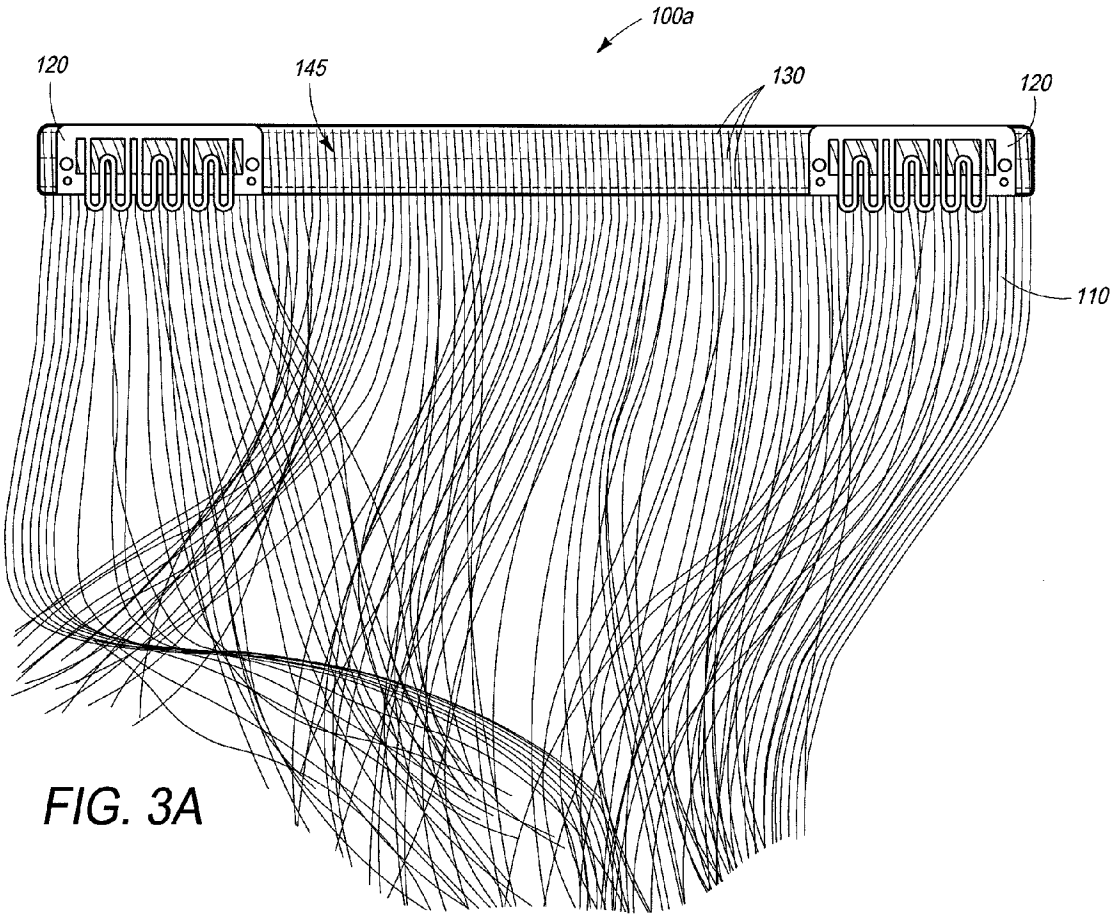
FIG. 3*a* shows a front view of the hair addition depicted in FIG. 2.
Figure 3B:
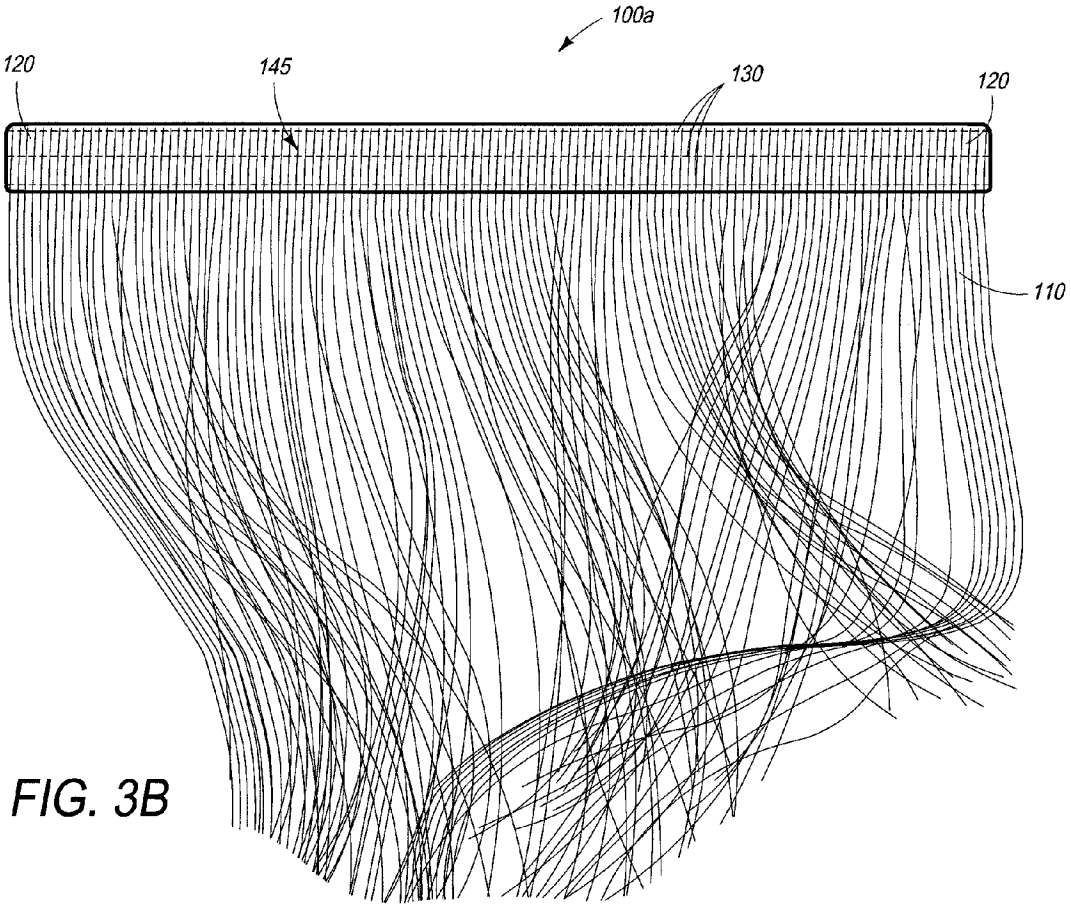
FIG. 3*b* shows a rear view of the hair addition of FIG. 3*a*.

FIGS. 3*a* and 3*b* show pictures of the embodiment 100*a* ready for use. In use, a hair addition 100 is fastened to the wearer's hair by the clip(s) 120. The wearer's own hair may then be blended in with the hair addition 100 as desired. Due to its construction, the hair addition 100 is very thin, but the hair strands 110 are nevertheless securely retained in the hair addition 100 (e.g., in the band 145). The strip 145 may be only slightly thicker than the diameter of the hair strands 110. For example, the strip 145 may have a diameter that is no more than three times a diameter of the hair strands 110, may preferably have a diameter that is no more than two times the diameter of the hair strands 110, and may even more preferably have a diameter that is no more than 25% to 50% greater than the diameter of the hair strands 110. This thinness may allow the strip 145 to lay very flat against the wearer's own hair, causing the hair addition 100 to easily blend in with the user's own hair. The clip(s) 120 may allow the hair addition to be reused, as desired.

Figure 4:
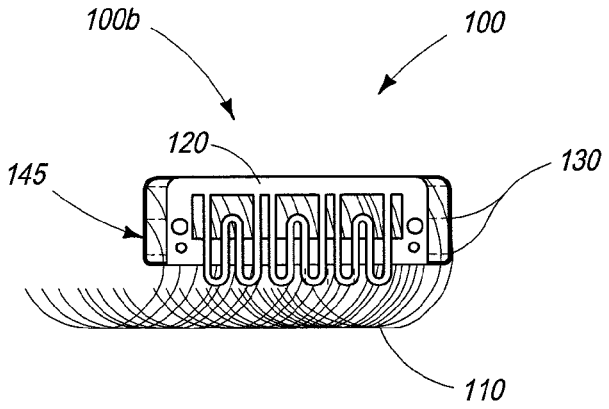
FIG. 4 shows a hair addition according to another embodiment.

FIG. 4 shows the embodiment 100*b* of the hair addition 100. The embodiment 100*b* differs from the embodiment 100*a* in that only one clip 120 is present and that less distance (e.g., about one inch) separates the ends 150*a*, 150*b*.

It should be appreciated that other embodiments may include more clips 120 than discussed above, and that various lengths between the ends 150*a*, 150*b* may be desirable. Additionally, the hair strands 110 may be of any configuration (e.g., length, color, curliness, etc.) depending on the hair style desired by the user. As a result, a user can utilize the addition of hair strands 110 to the user's natural hair to add thickness and provide various hair styles, some of which may not be attainable, or desirable in appearance, without the hair addition(s) 100. The hair strands 110 may include one or more of synthetic hair strands or natural hair strands. For synthetic hair strands, the hair may be fabricated from a polymer fiber such as modacrylic, or the synthetic hair may be fabricated from a polymer fiber other than modacrylic, such as, for example, acrylic.

Figure 5:
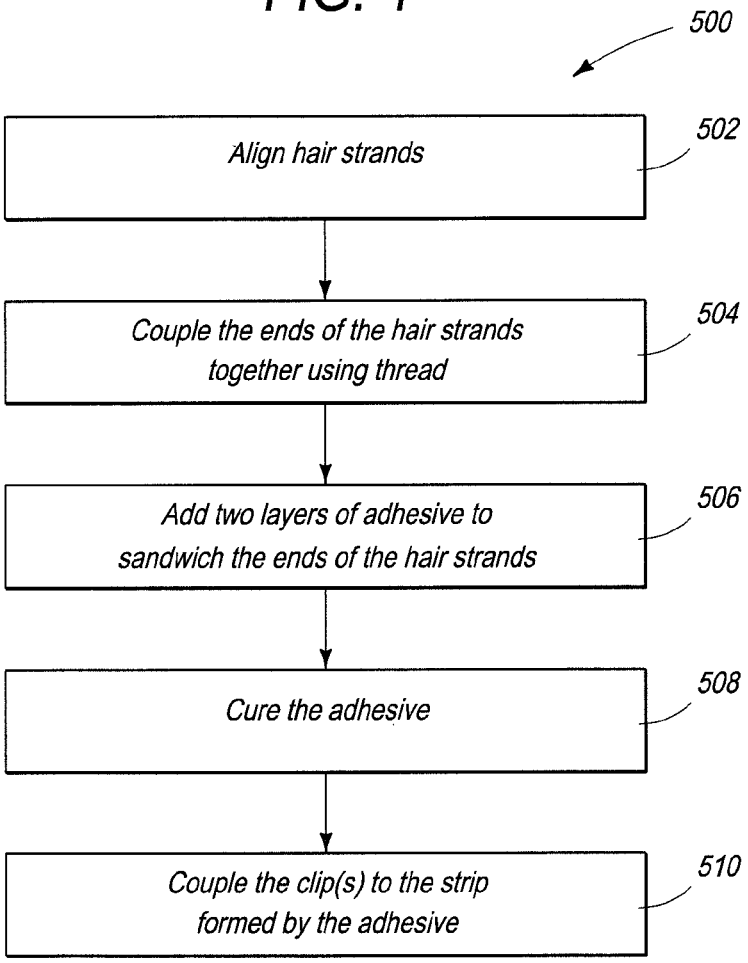
FIG. 5 is a flow chart showing a manufacturing process for a hair addition according to an embodiment.

FIG. 5 illustrates a manufacturing process 500 for creating the hair additions 100. At step 502, the hair strands 110 are aligned, and at step 504 the threads 130 couple the ends 112 of the hair strands 110 together. The adhesive 140 is then added at step 506 in two layers sandwiching the ends 112 of the hair strands 110 to further couple the ends 112 together. At step 508, the adhesive 140 is cured, such that it is no longer sticky, to form the strip 145. At step 510, each clip 120 is coupled to the strip 145 formed by the adhesive 140.

Returning to FIG. 1, the set 10 includes three hair additions 110*a* and two hair additions 110*b*. This may be desirable, as the hair additions 110*a* may be used at a rear area of the wearer's head and the hair additions 110*b* may be used at the sides of the wearer's head. It should be appreciated, however, that other sets may include different numbers of various embodiment of hair additions 100. Further, hair additions 100 may be marketed and employed individually instead of as a set.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. Further, it will be understood that certain features and subcombinations are of utility and may be employed without reference to other features and subcombinations and are contemplated within the scope of the claims. Further, various steps set forth herein may be carried out in orders that differ from those set forth herein without departing from the scope of the present methods. The description should not be restricted to the above embodiments, but should be measured by the claims.

I claim:

1. A hair addition, consisting essentially of:
a plurality of hair strands having upper and lower ends;
at least two threads coupling the hair strand upper ends together;
two layers of polyurethane sandwiching the hair strand upper ends and the at least two threads, the two layers of polyurethane forming a strip; and
at least one clip coupled to the strip.

2. The hair addition of claim 1, wherein three threads couple the hair strand upper ends together.

3. The hair addition of claim 2, wherein:
the hair strands have a diameter;
the strip has a diameter; and
the strip diameter is no more than three times the diameter of the hair strands.

4. The hair addition of claim 3, wherein:
the strip has an upper end adjacent one of the threads; and
the strip has a lower end adjacent another of the threads.

5. The hair addition of claim 4, wherein the strip upper and lower ends are generally linear and generally parallel to one another.

6. The hair addition of claim 5, wherein:
the strip has first and second side ends spaced apart from one another;
two clips are coupled to the strip; and
the first and second side ends of the strip extend beyond the two clips such that the two clips are inset along the strip.

7. The hair addition of claim 5, wherein at least one stitch couples the at least one clip coupled to the strip.

8. The hair addition of claim 1, wherein:
the hair strands have a diameter;
the strip has a diameter; and
the strip diameter is no more than 1.25 times the diameter of the hair strands.

9. The hair addition of claim 8, wherein:
the strip has an upper end adjacent one of the threads; and
the strip has a lower end adjacent another of the threads.

10. The hair addition of claim 9, wherein the strip upper and lower ends are generally linear and generally parallel to one another.

11. The hair addition of claim 10, wherein:
the strip has first and second side ends spaced apart from one another;
two clips are coupled to the strip; and
the first and second side ends of the strip extend beyond the two clips such that the two clips are inset along the strip and the hair strands.

12. The hair addition of claim 10, wherein:
the strip has first and second side ends spaced apart from one another;
one clip is coupled to the strip; and
the first and second side ends of the strip extend beyond the clip such that the clip is inset along the strip and the hair strands.

13. The hair addition of claim 8, wherein:
the strip has first and second side ends spaced apart from one another;
two clips are coupled to the strip; and
the first and second side ends of the strip extend beyond the two clips such that the two clips are inset along the strip and the hair strands.

14. The hair addition of claim 8, wherein:
the strip has first and second side ends spaced apart from one another;
one clip is coupled to the strip; and
the first and second side ends of the strip extend beyond the clip such that the clip is inset along the strip and the hair strands.

15. The hair addition of claim 1, wherein the hair strands are at least one of natural hair strands and synthetic hair strands.

16. A hair addition formed by the process consisting essentially of:
aligning a plurality of hair strands;
coupling an end of the hair strands together using at least one thread;
sandwiching the coupled end of hair strands and the at least one thread between two layers of polyurethane;
curing the two layers of polyurethane; and
coupling at least one clip to the cured layers of polyurethane.

17. The hair addition of claim 16, wherein the plurality of hair strands are aligned generally linearly.

18. A method of forming a hair addition, consisting essentially of:
aligning a plurality of hair strands;
coupling an end of the hair strands together using at least one thread;

sandwiching the coupled end of hair strands and the at least one thread between two layers of polyurethane;

curing the two layers of polyurethane; and coupling at least one clip to the cured layers of polyurethane.

* * * * *